US010947088B2

(12) United States Patent
Blanchard

(10) Patent No.: US 10,947,088 B2
(45) Date of Patent: Mar. 16, 2021

(54) ELEVATOR VIBRATION DAMPING DEVICE

(71) Applicants: OTIS ELEVATOR COMPANY, Farmington, CT (US); Antoine Adrian Blanchard, Gien (FR)

(72) Inventor: Antoine Adrian Blanchard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 635 days.

(21) Appl. No.: 15/739,178

(22) PCT Filed: Jul. 3, 2015

(86) PCT No.: PCT/IB2015/001254
§ 371 (c)(1),
(2) Date: Dec. 22, 2017

(87) PCT Pub. No.: WO2017/006146
PCT Pub. Date: Jan. 12, 2017

(65) Prior Publication Data
US 2018/0186605 A1 Jul. 5, 2018

(51) Int. Cl.

| | |
|---|---|
| ***B66B 7/06*** | (2006.01) |
| ***B66B 7/08*** | (2006.01) |
| ***B66B 9/00*** | (2006.01) |
| ***B66B 11/00*** | (2006.01) |

(52) U.S. Cl.
CPC ..... *B66B 7/068* (2013.01); *B66B 7/062* (2013.01); *B66B 7/08* (2013.01); *B66B 7/085* (2013.01); *B66B 9/00* (2013.01); *B66B 11/008* (2013.01)

(58) Field of Classification Search
CPC ..... B66B 7/068; B66B 7/062; B66B 7/08; B66B 7/085; B66B 9/00; B66B 11/008
USPC ..... 187/247
See application file for complete search history.

(56) References Cited

U.S. PATENT DOCUMENTS 5,294,757 A * 3/1994 Skalski ..... B66B 7/022 187/393
5,321,217 A * 6/1994 Traktovenko ..... B66B 1/44 187/393
5,322,144 A * 6/1994 Skalski ..... B66B 7/022 187/393
5,400,872 A * 3/1995 Skalski ..... B66B 1/44 187/393

(Continued)

FOREIGN PATENT DOCUMENTS

GB 2205921 A 12/1988
GB 2270292 A 3/1994

(Continued)

OTHER PUBLICATIONS

International Search Report for application No. PCT/IB2015/001254 dated Mar. 23, 2016; 3 pages.

(Continued)

*Primary Examiner* — David S Warren
(74) *Attorney, Agent, or Firm* — Cantor Colburn LLP

(57) ABSTRACT

An elevator system includes a stationary structure, a first sheave rotationally supported by the structure, a rope supported by the first sheave, and an elevator car supported by the rope. A vibration damping device of the elevator system is positioned at a first termination of the rope, and is configured to reduce vibration waves in the rope, thereby reducing noise in the elevator car.

19 Claims, 3 Drawing Sheets

(56) References Cited

U.S. PATENT DOCUMENTS 5,750,945 A 5/1998 Fuller et al.
5,862,888 A * 1/1999 Iwakiri ..... B66B 7/08 187/345
6,315,084 B1 * 11/2001 Shon ..... B66B 7/08 187/292
6,763,917 B2 * 7/2004 Utsunomiya ..... B66B 7/042 187/292
7,401,683 B2 * 7/2008 Husmann ..... B66B 7/046 187/292
7,621,377 B2 11/2009 Husmann
7,784,590 B2 * 8/2010 Watanabe ..... B66B 5/022 187/393
7,793,763 B2 * 9/2010 Zhu ..... B66B 7/06 187/411
8,141,685 B2 * 3/2012 Utsunomiya ..... B66B 7/042 187/292
8,162,110 B2 4/2012 Smith et al.
8,297,412 B2 10/2012 Roberts et al.
8,746,411 B2 * 6/2014 Roberts ..... B66B 17/34 187/284
9,038,782 B2 * 5/2015 Blanchard ..... B66B 7/08 187/411
9,038,783 B2 * 5/2015 Roberts ..... B66B 7/08 187/412
9,359,172 B2 * 6/2016 Mangini ..... B66B 7/06
9,394,138 B2 * 7/2016 Blanc ..... G01H 3/00
9,957,133 B2 * 5/2018 Shiraishi ..... B66B 7/10
10,005,641 B2 * 6/2018 Smith ..... B66B 7/048
10,737,907 B2 * 8/2020 Guo ..... B66B 17/34
2003/0111302 A1 * 6/2003 Utsunomiya ..... B66B 7/042 187/410
2003/0192745 A1 * 10/2003 Utsunomiya ..... B66B 7/042 187/292
2005/0145439 A1 * 7/2005 Husmann ..... B66B 7/046 187/292
2005/0145440 A1 * 7/2005 Husmann ..... B66B 7/046 187/292
2006/0102434 A1 * 5/2006 Nomura ..... B66B 11/009 187/266
2006/0266591 A1 * 11/2006 Zhu ..... B66B 7/06 187/411
2007/0000732 A1 * 1/2007 Kulak ..... B66B 7/044 187/346
2007/0012524 A1 * 1/2007 Valjus ..... B66B 7/10 187/412
2009/0114484 A1 * 5/2009 Watanabe ..... B66B 5/022 187/278
2009/0266650 A1 * 10/2009 Utsunomiya ..... B66B 11/028 187/391
2011/0297489 A1 * 12/2011 Blanchard ..... B66B 7/10 187/411
2013/0240302 A1 * 9/2013 Blanc ..... G01H 1/12 187/292
2014/0124300 A1 * 5/2014 Benosman ..... B66B 7/06 187/247
2014/0229011 A1 * 8/2014 Fukui ..... G05B 15/02 700/275
2015/0008075 A1 * 1/2015 Benosman ..... B66B 7/06 187/247
2015/0027814 A1 * 1/2015 Benosman ..... B66B 7/06 187/247
2015/0246791 A1 * 9/2015 Smith ..... B66B 7/06 187/264
2015/0353323 A1 * 12/2015 Shiraishi ..... B66B 5/12 187/266
2017/0050820 A1 * 2/2017 Kondo ..... B66B 5/0093
2017/0247226 A1 * 8/2017 Roberts ..... B66B 5/0031
2018/0186605 A1 * 7/2018 Blanchard ..... B66B 9/00

FOREIGN PATENT DOCUMENTS

JP 2003192242 A 7/2003
JP 2009221008 A 10/2009
JP 2010184747 A 8/2010
JP 2014159328 A 9/2014
WO 2007125781 A1 11/2007
WO 2010013597 A1 2/2010
WO 2010019117 A1 2/2010
WO 2013080826 A1 6/2013
WO 2013158073 A1 10/2013
WO 2013184085 A1 12/2013
WO 2014137345 A1 9/2014

OTHER PUBLICATIONS

Written Opinion of the International Searching Authority for application No. PCT/IB2015/001254 dated Mar. 23, 2016; 6 pages.

* cited by examiner

ELEVATOR VIBRATION DAMPING DEVICE

CROSS-REFERENCES TO RELATED APPLICATIONS

This patent application is a National Stage Application of PCT/IB2015/001254, filed Jul. 3, 2015, which is incorporated herein by reference in its entirety.

BACKGROUND

The present disclosure relates to an elevator, and more particularly, to a vibration damping device of the elevator.

One of the most popular elevator designs is known as a roped elevator. In such designs the elevator car of the elevator is raised and lowered by steel ropes, elevator cables or belts rather than (for example) pushed hydraulically from below. The ropes are typically looped around a sheave (e.g., pulley) connected to an electric motor. When the motor turns in one rotational direction, the elevator car rises; and, when the motor turns in an opposite rotational direction, the elevator car lowers. The elevator may be gearless with the motor connected directly to the sheave or may include gears generally positioned between the motor and the sheave. Traditionally, the sheave, motor and related electric control systems are housed in a machine room positioned above an elevator shaft that the elevator car moves within; however, the need for such rooms are becoming less common.

Secured to the top of the elevator car may be a second pulley. The rope may extend from the first sheave and down to the second pulley where the rope loops through the pulley and extends upward to the top of the shaft where an end of the rope is rigidly secured. An opposite end of the rope (or a second rope) may be secured to a counterweight of the elevator that may generally hang from the other side of the first sheave. Typically, the counterweight weighs about the same as the elevator car when filled to about fifty percent capacity. Use of the counterweight conserves energy and reduces the work output of the motor required to raise the elevator car.

Many other features are included as part of the elevator that contribute toward a smooth, quiet and comfortable ride. For example, the elevator shaft may generally include a series of rails that keep the elevator car and counterweight from swaying back and forth. However, further noise reduction and/or vibration damping is still desirable to contribute further to ride comfort.

SUMMARY

An elevator vibration damping device constructed and arranged to mount to a termination of a rope according to one, non-limiting, embodiment of the present disclosure includes an electronic controller; an accelerometer configured to sense vibration waves and send a vibration signal to the electronic controller; and an actuator configured to receive a damping command from the electronic controller and transmit energy into the termination.

Additionally to the foregoing embodiment, the vibration waves include longitudinal vibration waves and the actuator is constructed and arranged to reduce longitudinal vibration waves in the rope.

In the alternative or additionally thereto, in the foregoing embodiment, the vibration waves include lateral vibration waves and the actuator is constructed and arranged to reduce lateral vibration waves in the rope.

In the alternative or additionally thereto, in the foregoing embodiment, the controller, the accelerometer and the actuator are packaged as one unit.

An elevator system according to another, non-limiting, embodiment includes a stationary structure; a first sheave rotationally supported by the structure; a rope supported by the first sheave and including a first termination; an elevator car supported by the rope; and a first vibration damping device configured to inject energy into the rope for reducing vibration waves.

Additionally to the foregoing embodiment, the first vibration damping device is positioned at the first termination which is load bearing.

In the alternative or additionally thereto, in the foregoing embodiment, the system includes a drive system including the first sheave constructed and arranged to controllably drive the rope, and wherein the vibration damping device is integrated into the drive system for injecting energy into the rope through the first sheave to reduce longitudinal vibration.

In the alternative or additionally thereto, in the foregoing embodiment, the rope is a coated steel belt.

In the alternative or additionally thereto, in the foregoing embodiment, the first termination is at the stationary structure and the vibration wave is a longitudinal vibration wave with respect to the rope.

In the alternative or additionally thereto, in the foregoing embodiment, the elevator system includes a second sheave rotationally supported by the elevator car, wherein the rope extends substantially downward from the first sheave to the second sheave and substantially upward from the second sheave and to the first termination supported by the structure.

In the alternative or additionally thereto, in the foregoing embodiment, the elevator system includes a counterweight supported by a first portion of the rope; and a third sheave rotationally supported by the counterweight, and wherein the first portion of the rope substantially extends downward from the first sheave and through the third sheave and substantially upward to the first termination supported by the structure.

In the alternative or additionally thereto, in the foregoing embodiment, the elevator system includes a second sheave rotationally supported by the elevator car, wherein a second portion of the rope extends substantially downward from the first sheave to the second sheave and substantially upward from the second sheave and to a second termination supported by the structure; and a second vibration damping device positioned at the second termination configured to reduce longitudinal vibration waves in the second portion.

In the alternative or additionally thereto, in the foregoing embodiment, the elevator system includes a counterweight supported by a first portion of the rope extending at least in-part downward from the first sheave, and wherein a second portion of the rope extends at least in-part downward from the first sheave to the elevator car.

In the alternative or additionally thereto, in the foregoing embodiment, the first termination is disposed at the elevator car the vibration waves include longitudinal vibration waves with respect to the second portion.

In the alternative or additionally thereto, in the foregoing embodiment, the first termination is disposed at the elevator car and the vibration waves include lateral vibration waves with respect to the second portion.

In the alternative or additionally thereto, in the foregoing embodiment, the first termination is disposed at the counterweight and the vibration waves include longitudinal vibration waves with respect to the first portion.

In the alternative or additionally thereto, in the foregoing embodiment, the first termination is disposed at the counterweight, and the vibration waves include lateral vibration waves with respect to the first portion.

In the alternative or additionally thereto, in the foregoing embodiment, the vibration damping device includes an electronic controller, an accelerometer configured to sense the vibration waves and send a vibration signal to the electronic controller, and an actuator configured to receive a damping command from the electronic controller and transmit energy into the first termination.

A method of reducing noise in an elevator car of an elevator system according to another, non-limiting, embodiment includes sensing vibration waves at a termination of an elevator rope by an accelerometer; and injecting energy into the termination by an actuator to cancel out at least a portion of the sensed vibration waves.

Additionally to the foregoing embodiment, the method includes transmitting a signal indicative of sensed vibration waves from the accelerometer and to an electronic controller; processing the signal by the controller; and sending a signal command to the actuator indicative of energy to be transmitted to the termination.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
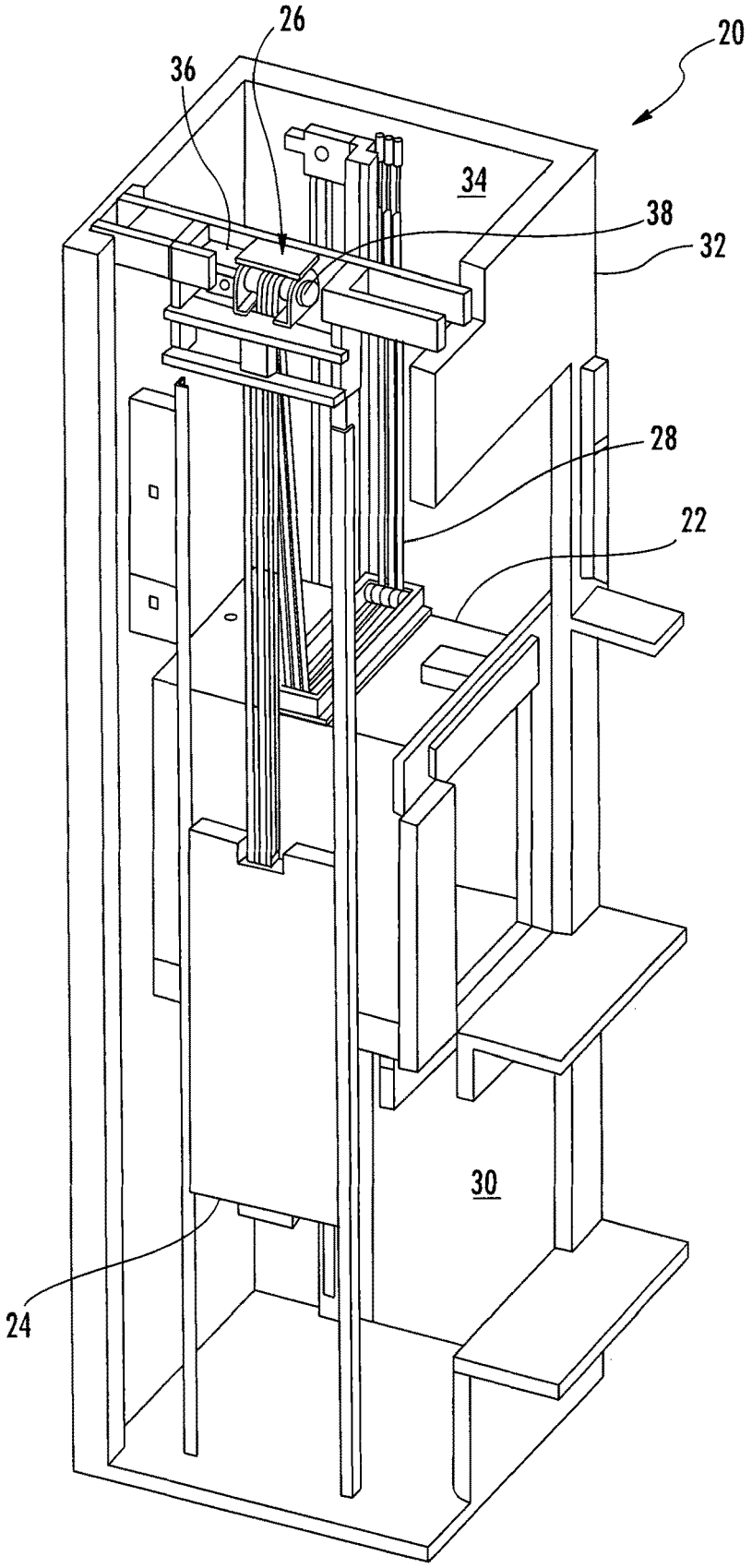
FIG. 1 is a perspective view of an elevator system with parts broken away to show internal detail as one, non-limiting, exemplary embodiment of the present disclosure.

Referring to FIG. 1, an elevator system 20 of the present disclosure is illustrated. The elevator system 20 may include an elevator car 22, a counterweight 24, a drive system 26, and a rope 28. The elevator car 22 may carry passengers or other objects and is constructed to move substantially vertically in a hoistway 30 of the elevator system 20. Boundaries of the hoistway 30 may be defined by a stationary structure or building 32 that may utilize and house the elevator system 20. The drive system 26 may be housed in a machine room 34 of the building 32 located generally above the hoistway 30, and may include an electric motor 36 that rotates a sheave 38. The rope 28 is wrapped about the sheave 38 and extends between the elevator car 22 and the counterweight 24 such that when the drive system 26 receives a command signal to raise the elevator car 22, the sheave is rotated in a first direction that lowers the counterweight 24 as the elevator car 22 rises, and vice-versa. The counterweight 24 generally weighs about the same as the elevator car 22 when at about fifty percent capacity, and thus reduces the work output requirements of the drive system 26.

Figure 2:
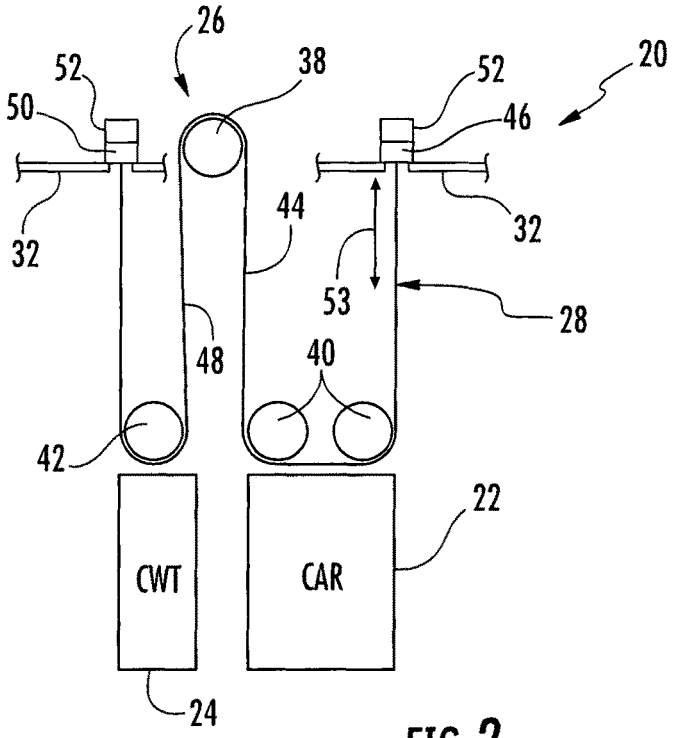
FIG. 2 is a block diagram of the elevator system.

Referring to FIGS. 1 and 2, the elevator system 20 may further include at least one sheave or pulley 40 (i.e., two illustrated) rotationally mounted to the elevator car 22, and a sheave or pulley 42 rotationally mounted to the counterweight 24. From the sheave 38 of the drive system 26, a car portion 44 of the rope 28 may generally extend in a downward direction, then wrap about the sheave 40, and extend back upward to a termination 46 of the rope 28. Similarly and from an opposite side of the sheave 38 of the drive system 26, a counterweight portion 48 of the rope 28 may generally extend in a downward direction, wrap about the sheave 42, and extend back upward to a termination 50 of the rope 28. Both terminations 46, 50 of the rope 28 may be load bearing and may be secured to and supported by the structure 32.

The rope 28 may be any variety of flexible and elongated members and includes braided elevator cables that may be steel, and belts. The belts may include a series of small elevator cables or straps coated with any variety of materials (e.g., polyurethane) and referred to as coated steel belts (CSB). It is further contemplated and understood that the rope 28 may include a series of ropes aligned side-by-side with each rope wrapped about the sheaves 38, 40, 42 in respective grooves. It is further understood that the car and counterweight portions 44, 48 of the rope 28 may generally be separated at the sheave 38 of the drive system 26 with the car portion 44 wrapping about the sheave 38 in a first rotational direction, and the counterweight portion 48 wrapping about the sheave 38 in an opposite rotational direction. It is further understood that the portion 44, 48 may be other than car and counterweight portions and is dependent upon any number of non-limiting examples of sheave arrangements. For example, an elevator system may not have a counterweight, yet may still have two rope portions on either side of a motor driven sheave.

Figure 3:
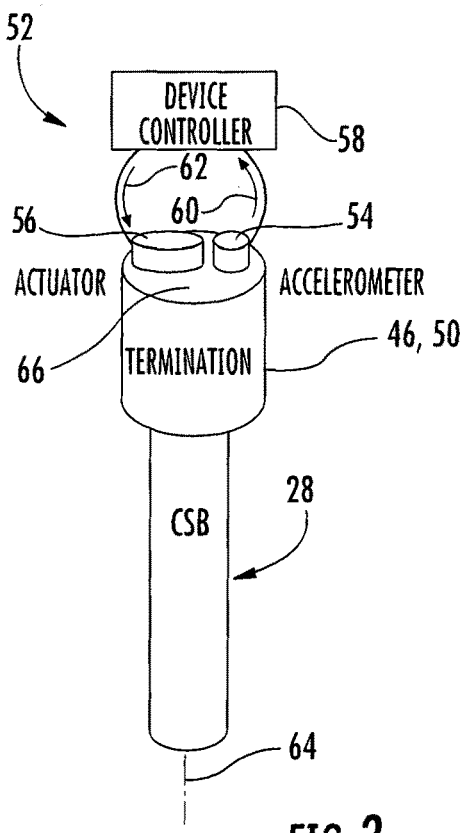
FIG. 3 is a schematic of a vibration damping device of the elevator system.

Referring to FIGS. 2 and 3, the terminations 46, 50 may be dead end hitches as is generally known in the art. Associated with at least one of the terminations 46, 50 is a vibration damping device 52 configured to reduce longitudinal vibration waves (see arrow 53 in FIG. 2) in the rope 28 that may otherwise be transmitted to the elevator car 22 and contribute toward noise. The vibration damping device 52 may include an accelerometer 54, an actuator 56 and an electronic controller 58. The accelerometer 54 and the actuator 56 may be mounted directly to the terminations 46, 50, and the electronic controller 58 may receive data signals (see arrow 60 in FIG. 3) from the accelerometer and issue command signals (see arrow 62) to the actuator 56 over wired and/or wireless paths. The electronic controller 58 may be remotely located or may be packaged together with the accelerometer 54 and actuator 56 producing one compact module for easy installation. Moreover the device 52 may be retrofitted onto existing elevator systems without modifying pre-installed structures or components. It is further understood that if the rope 28 actually includes a plurality of ropes typically aligned side-by-side, each rope is associated with a respective vibration damping device 52 for damping longitudinal vibration waves.

It is further contemplated that the actuator 56 of the vibration damping device 52 may be integrated into the drive system 26. The drive system 26 may inject energy by controlling the system's acyclisms via current sheave rotation commands. The energy is thus injected through the sheave 38 and into the rope 28 thus damping longitudinal vibration waves in the rope.

Figure 4:
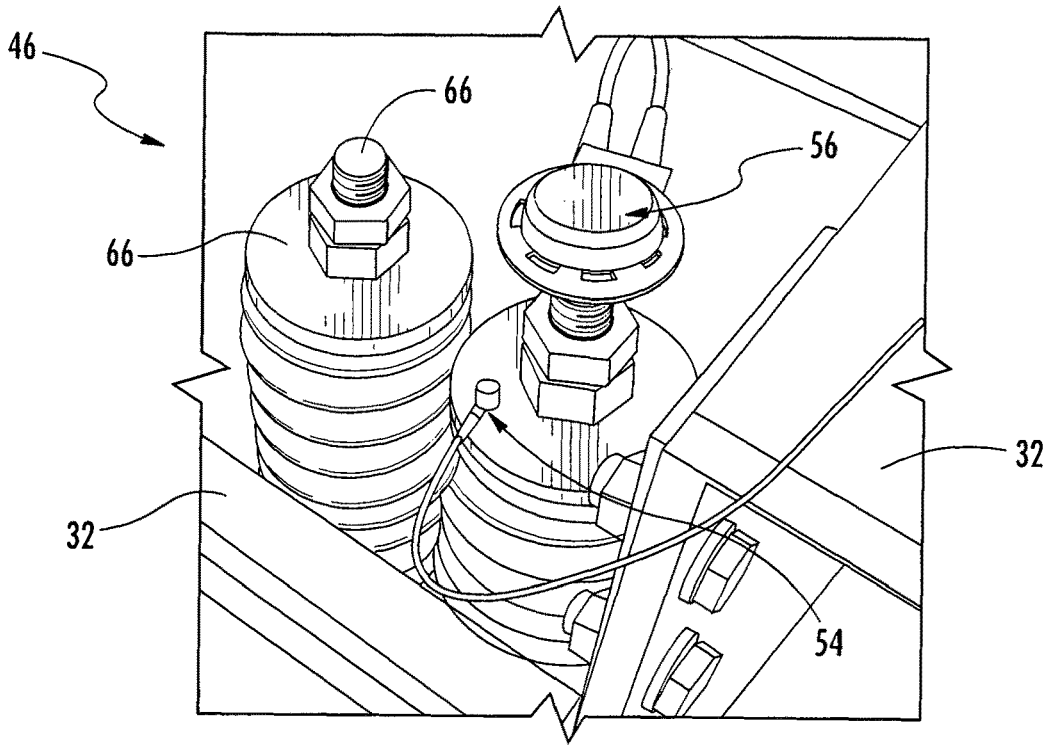
FIG. 4 is a perspective view of an actuator and an accelerometer of the device and secured to a rope termination.

In operation, the elevator system 20 may produce longitudinal vibrations along the length of the rope 28. More specifically, elevator operation may produce longitudinal displacement of the rope 28 along a rope centerline 64 having a vibration frequency and longitudinal amplitude that may contribute toward noise within the elevator car 22. The vibration damping device 52 facilitates the substantial cancellation of the longitudinal vibration waves by adding energy to rope 28 at the terminations 46, 50. Each termination 46, 50 may include a surface 66 that is substantially normal to the centerline 64 proximate to the terminations, and that faces in an opposite direction than the projecting direction of the rope 28. The accelerometer 54 and the actuator 56 may be rigidly mounted to the surface 66. The surface 66 may further be the end of a threaded bolt utilized as part of the termination 46, 50 to secure the rope 28 to the structure 32 (see FIG. 4).

In operation and as the elevator car 22 travels up and down, longitudinal vibration waves may be transmitted through the rope 28. The accelerometer 54 senses the longitudinal vibration waves and transmits the data to the controller 58 that electronically processes the data and issues the command signal 62 to the actuator 56. The actuator 56 may then transmit appropriate degrees of energy into the rope 28 to cancel-out the longitudinal vibration waves. It is further contemplated and understood that the vibration damping device 52 may not completely cancel all longitudinal vibration but may transmit enough energy and at appropriate frequencies into the rope 28 to prevent resonating vibrations.

Figure 5:
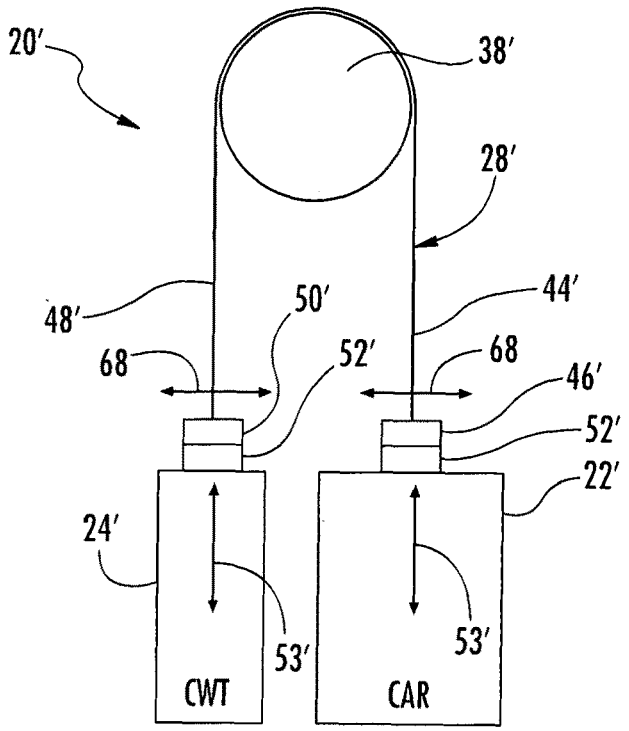
FIG. 5 is a block diagram of a second embodiment of an elevator system utilizing the vibration damping device.

Referring to FIG. 5, a second embodiment of an elevator system is illustrated wherein like elements to the first embodiment have like identifying numerals except with the addition of a prime symbol suffix. The elevator system 20' may include a car portion 44' having a termination 46' at an elevator car 22'. Similarly, the counterweight portion 48' may have a termination 50' at a counterweight 24'. Vibration damping devices 52' may be mounted to each termination 46', 50'.

The counterweight 24' and/or the elevator car 22' may experience noise attributable from lateral vibration waves (see arrow 68) and/or longitudinal vibration waves 53'. The vibration damping device 52' of elevator system 20' may be configured to both the lateral and longitudinal vibration waves 68, 53'.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator vibration damping device constructed and arranged to mount to a termination of a rope, the device comprising:

an electronic controller;

an accelerometer configured to sense vibration waves and send a vibration signal to the electronic controller; and an actuator configured to receive a damping command from the electronic controller and transmit energy into the termination, wherein the vibration waves include lateral vibration waves and the actuator is constructed and arranged to reduce lateral vibration waves in the rope.

2. The elevator vibration damping device set forth in claim 1, wherein the vibration waves include longitudinal vibration waves and the actuator is constructed and arranged to reduce longitudinal vibration waves in the rope.

3. The elevator vibration damping device set forth in claim 1, wherein the controller, the accelerometer and the actuator are packaged as one unit.

4. An elevator system comprising:

a stationary structure;

a first sheave rotationally supported by the structure;

a rope supported by the first sheave and including a first termination;

an elevator car supported by the rope; and a first vibration damping device configured to inject energy into the rope for reducing vibration waves, wherein the vibration waves include lateral vibration waves and the actuator is constructed and arranged to reduce lateral vibration waves in the rope.

5. The elevator system set forth in claim 4, wherein the first vibration damping device is positioned at the first termination which is load bearing.

6. The elevator system set forth in claim 5, further comprising:

a second sheave rotationally supported by the elevator car, wherein the rope extends substantially downward from the first sheave to the second sheave and substantially upward from the second sheave and to the first termination supported by the structure.

7. The elevator system set forth in claim 5, further comprising:

a counterweight supported by a first portion of the rope; and a third sheave rotationally supported by the counterweight, and wherein the first portion of the rope substantially extends downward from the first sheave and through the third sheave and substantially upward to the first termination supported by the structure.

8. The elevator system set forth in claim 7 further comprising:

a second sheave rotationally supported by the elevator car, wherein a second portion of the rope extends substantially downward from the first sheave to the second sheave and substantially upward from the second sheave and to a second termination supported by the structure; and a second vibration damping device positioned at the second termination configured to reduce longitudinal vibration waves in the second portion.

9. The elevator system set forth in claim 5, further comprising:

a counterweight supported by a first portion of the rope extending at least in-part downward from the first sheave, and wherein a second portion of the rope extends at least in-part downward from the first sheave to the elevator car.

10. The elevator system set forth in claim 9, wherein the first termination is disposed at the elevator car, and the vibration waves include longitudinal vibration waves with respect to the second portion.

11. The elevator system set forth in claim 9, wherein the first termination is disposed at the elevator car the vibration waves include lateral vibration waves with respect to the second portion.

12. The elevator system set forth in claim 9, wherein the first termination is disposed at the counterweight and the vibration waves include longitudinal vibration waves with respect to the first portion.

13. The elevator system set forth in claim 9, wherein the first termination is disposed at the counterweight and the vibration waves include lateral vibration waves with respect to the first portion.

14. The elevator system set forth in claim 5, wherein the vibration damping device includes an electronic controller, an accelerometer configured to sense the vibration waves and send a vibration signal to the electronic controller, and an actuator configured to receive a damping command from the electronic controller and transmit energy into the first termination.

15. The elevator system set forth in claim 4 further comprising:

a drive system including the first sheave constructed and arranged to controllably drive the rope, and wherein the vibration damping device is integrated into the drive system for injecting energy into the rope through the first sheave to reduce longitudinal vibration.

16. The elevator system set forth in claim 4, wherein the rope is a coated steel belt.

17. The elevator system set forth in claim 5, wherein the first termination is at the stationary structure and the vibration wave is a longitudinal vibration wave with respect to the rope.

18. A method of reducing noise in an elevator car of an elevator system comprising:

sensing vibration waves at a termination of an elevator rope by an accelerometer; and injecting energy into the termination by an actuator to cancel out at least a portion of the sensed vibration waves, wherein the vibration waves include lateral vibration waves and the actuator is constructed and arranged to reduce lateral vibration waves in the rope.

19. The method set forth in claim 18 further comprising:

transmitting a signal indicative of sensed vibration waves from the accelerometer and to an electronic controller;

processing the signal by the controller; and sending a signal command to the actuator indicative of energy to be transmitted to the termination.

* * * * *